US006626006B1

(12) United States Patent
Tedder

(10) Patent No.: US 6,626,006 B1
(45) Date of Patent: Sep. 30, 2003

(54) STACKABLE COOLER SHELVING SYSTEM

(76) Inventor: Carl Kenneth Tedder, 14 Racquet Court La., Walterboro, SC (US) 29488

( * ) Notice: Subject to any disclaimer, the term of this patent is extended or adjusted under 35 U.S.C. 154(b) by 0 days.

(21) Appl. No.: 10/133,952

(22) Filed: Jun. 15, 2002

(51) Int. Cl.[7] ..... F25D 3/08
(52) U.S. Cl. ..... 62/457.7; 220/915.2
(58) Field of Search ..... 62/457.7; 220/915.1, 220/915.2, 630, 759; 211/188, 153

(56) References Cited

U.S. PATENT DOCUMENTS 3,640,389 A * 2/1972 Snyder ..... 108/108
4,424,687 A * 1/1984 Morgan ..... 62/457.1
4,515,421 A 5/1985 Steffes
4,565,074 A 1/1986 Morgan
4,595,107 A * 6/1986 Welsch ..... 108/147.13
5,052,184 A * 10/1991 Jarvis ..... 62/372
5,052,185 A 10/1991 Spahr
5,238,128 A * 8/1993 Stoddard ..... 211/133.1
5,407,262 A * 4/1995 Christian et al. ..... 108/190
5,524,761 A 6/1996 Wayman
5,605,056 A * 2/1997 Brown et al. ..... 312/210
5,722,544 A * 3/1998 Williams ..... 108/107
5,816,432 A 10/1998 Hammen et al.
5,931,019 A 8/1999 White et al.
5,953,931 A * 9/1999 Brittain ..... 220/371
6,039,202 A 3/2000 Olstad et al.
6,126,124 A 10/2000 Wagner
6,276,162 B1 8/2001 Schemel
6,318,570 B1 * 11/2001 Mueller et al. ..... 211/126.7

* cited by examiner

*Primary Examiner*—William E. Tapolcai
*Assistant Examiner*—Mohammad M. Ali
(74) *Attorney, Agent, or Firm*—Kathleen M. Harleston; Harleston Law Firm LL

(57) ABSTRACT

An adjustable, removable shelving system for separating items stored in a cooler from ice or water in the cooler, including:

(a) at least one generally flat, rectangular-shaped, one-piece, stackable, generally horizontally oriented shelf;

(b) a number of generally circular, spaced-apart apertures in the shelf;

(c) a number of evenly spaced, same-sized stationary legs projecting down from the shelf; and (d) a plurality of same-sized, reversible leg extensions, each including a projection on one end of the leg extension, which extends in the same direction as the remainder of the leg extension, each of the leg extensions further comprising a bore in an opposite end; wherein the projection of the leg extension is closely insertable in one of the apertures of the shelf, and a portion of the stationary leg is closely insertable in the bore of a leg extension. A generally flat, flexible, removable handle is preferably positioned across an upper surface of the shelf, each handle extending across a portion of an upper surface of a shelf, each handle end being detachably insertable in a shelf aperture.

3 Claims, 6 Drawing Sheets

STACKABLE COOLER SHELVING SYSTEM

BACKGROUND OF THE INVENTION

1. Technical Field

The present device is a stackable, removable, adjustable shelving system for separating items stored in an ice chest or cooler from exposure to ice, ice substitute, or ice melt in the cooler or ice chest, the shelving system including at least one perforated shelf and reversible leg extensions.

2. Background Information

Many adults and children who live along or visit the coast enjoy going fishing, shrimping, and crabbing. These recreational fishermen, shrimpers, crabbers, etc. usually bring portable ice coolers filled with ice along with them on their trips to hold their beverages and food, and/or their catch for the day. Conventional coolers do keep such items cool for a time, but there is a need to keep water from the ice melting in the cooler separate from the contents of the cooler. Aside from the obvious inconvenience of wet food and beverages stored in ice melt, keeping fish, shrimp, crabs, oysters, etc. in melted water in a cooler over time can subject the handler and consumers to bacterial contamination. If one oyster is contaminated with a species of bacteria, for example, the bacteria is likely to multiply and spread in the melt water on a warm day, particularly among the oysters at the bottom of the cooler. The water increases the likelihood that other seafood in the cooler will also be contaminated, particularly when the cooler is swayed by the motion of a boat, or moved by the fisherman. Also, crabs and certain other salt-water invertebrates are particularly sensitive to storage in ice and cold melt water, and often die when they are stored in a cooler. Preventing ice and melt water in the cooler from contacting such animals is therefore advantageous.

These and other problems have been solved by the present invention, which is a adjustable shelving system, with a relatively flat, removable, one-piece shelf and optional leg extensions, for use in conventional ice chests or coolers. Ice or ice substitutes can be stored above or beneath these shelves, according to the intended use of the cooler. Each shelf has a number of small, spaced-apart apertures for draining off melt from the ice. Melted ice, or a spilled liquid, will drain down through the apertures in the stacked shelves to the bottom of the cooler. One preferred embodiment of the shelving system herein partitions the ice at the top ¾ or so of the cooler. In this preferred embodiment, the stored items are suspended on the shelves between the ice and the ice melt. A shelving system according to the present invention includes a number of stationary legs extending down from the shelf in a vertical direction. When the shelf is in use, these stationary legs hold the shelf several inches off the bottom of the cooler, to prevent goods on the shelf from contacting the ice melt. Optional leg extensions placed over or in the stationary legs can increase the height of the shelf.

A shelving system according to the present invention includes at least one perforated shelf and a number of reversible leg extensions. The shelves can be custom designed by the user to fit close to the bottom of the cooler, or farther away (e.g., where the cooler will be filled with a lot of ice). With the present cooler shelving system, the shelves can be stacked close to each other, or farther away from each other, depending on what items will be stored in the cooler and where the ice or ice substitute will be placed.

A flexible, removable, generally flat, strip handle on an upper surface of the shelf can be grasped for removing the shelf from the cooler. Since it is collapsible, items can be placed on top of the handle, and the handle does not interfere with placement of items on the shelf or with the stacking of one shelf on another. A user can move the handle to any desired area of the shelf, according to the use intended for the cooler that day.

BRIEF SUMMARY OF THE INVENTION

The present invention is a lightweight, adjustable, removable shelving system for separating items stored in a cooler from ice or water in the cooler, which comprises:

(a) at least one generally flat, rectangular-shaped, one-piece, stackable, generally horizontally oriented shelf;

(b) a plurality of generally circular, spaced-apart apertures in the shelf;

(c) a plurality of evenly spaced, same-sized stationary legs projecting downwardly in a generally vertical direction from the lower surface of the generally horizontally oriented shelf; and (d) a plurality of same-sized, reversible leg extensions, each comprising a projection on one end of the leg extension, the projection extending in the same direction as the remainder of the leg extension, the projection having a diameter smaller than the diameter of the remainder of the leg extension; at least one of the apertures having a diameter sufficient to closely accommodate the projection; each of the leg extensions further comprising a bore in an opposite end, the bore of each of the leg extensions having a diameter of a size for closely accommodating one of the stationary legs;

wherein the projection of the leg extension is closely insertable in one of the apertures of the shelf, and a portion of the stationary leg is closely insertable in the bore of a leg extension.

At least one generally flat, flexible handle positionable across a portion of an upper surface of the shelf is preferably also included. The handle has two opposite, like ends, each handle end being closely and detachably insertable in at least one of the shelf apertures. Also included herein is a stackable, adjustable shelving system for a cooler comprising at least two of the perforated, unitary, stackable shelves, a plurality of the stationary legs affixed to the shelves, a plurality of the reversible leg extensions, and at least one of the handles.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
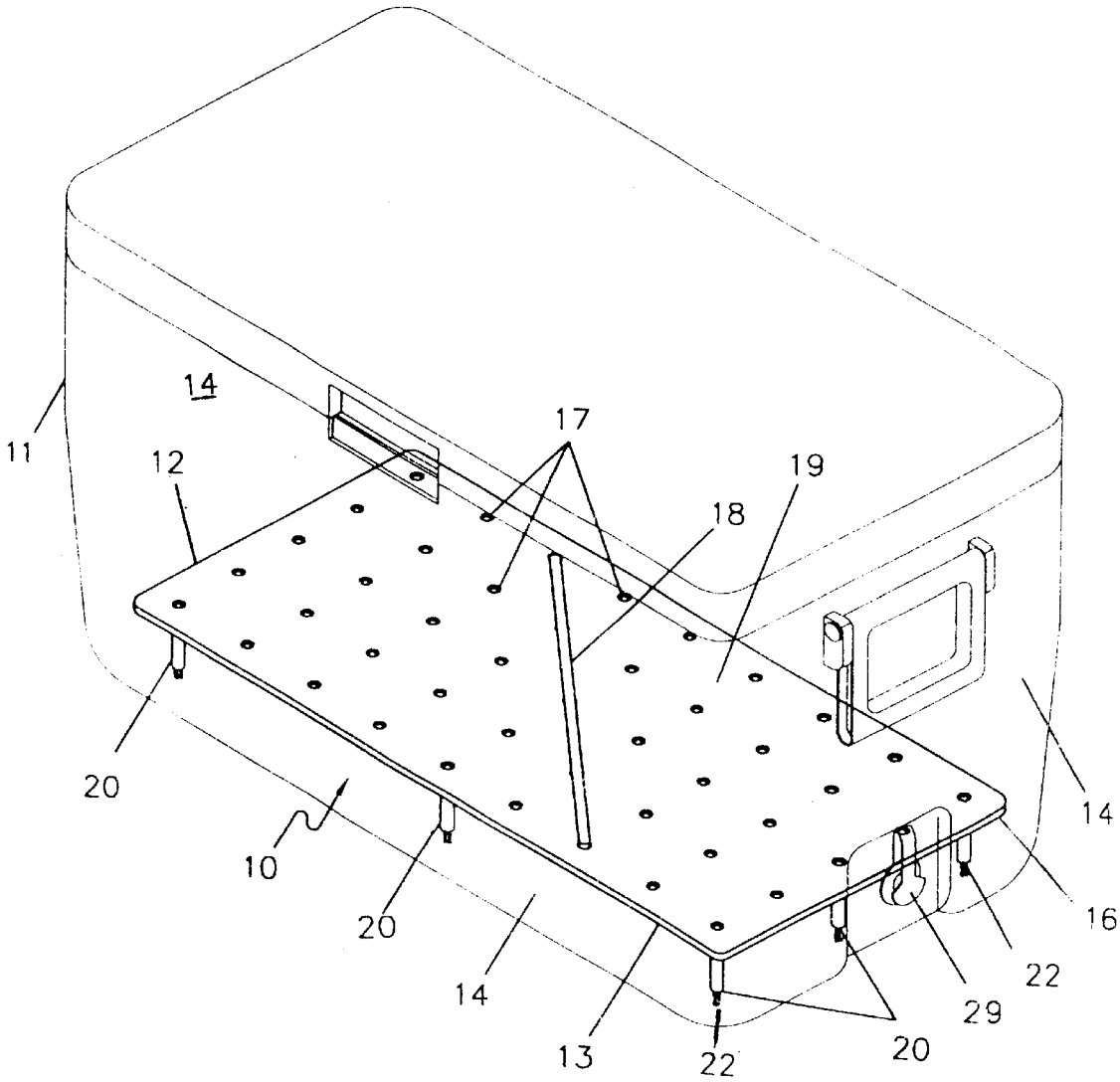
FIG. 1 is a perspective view of a stackable shelf according to the present invention, shown positioned inside a cooler.

In the following description, like reference characters designate like or corresponding parts throughout the several views. Also, in the following description, it is to be understood that such terms as "bottom," "top," and the like are words of convenience and are not to be construed as limiting terms. Referring in more detail to the drawings, the invention will now be described.

Turning to FIG. 1, the present invention includes a shelf system, generally referred to as 10, shown with a single generally flat, rectangular-shaped, horizontally-oriented shelf 12 positioned at the bottom of a portable cooler 11. The shelf is dimensioned for being received within an interior of a conventional cooler, so the shelf 12, when inserted into the cooler 11, will fit across the cooler 11 with little or no gap between the edges of the shelf 12 and the sides 14 of the cooler 11. Since the shelf 12 is generally rectangular in shape, it has two opposed long edges 13, and two opposed shorter end edges 16. This shelf is also useful for storing items in an ice chest, or other types of containers used for keeping items cool with ice or ice substitutes. A shelving system 10 herein includes: at least one shelf 12, a plurality of stationary legs 15 and/or leg extensions 20, and a generally flat, flexible handle 18.

The shelf 12 is not ribbed or constructed of connecting parts; therefore, items placed on the shelf, such as cans and jars, are less likely to tip over, as they might on a shelf with a rough or irregular surface. The shelf 12 is preferably unitary with a smooth surface, so that items remain standing on the shelf, even when the cooler is in transit. By unitary is meant that the shelf is one-piece.

Figure 2:
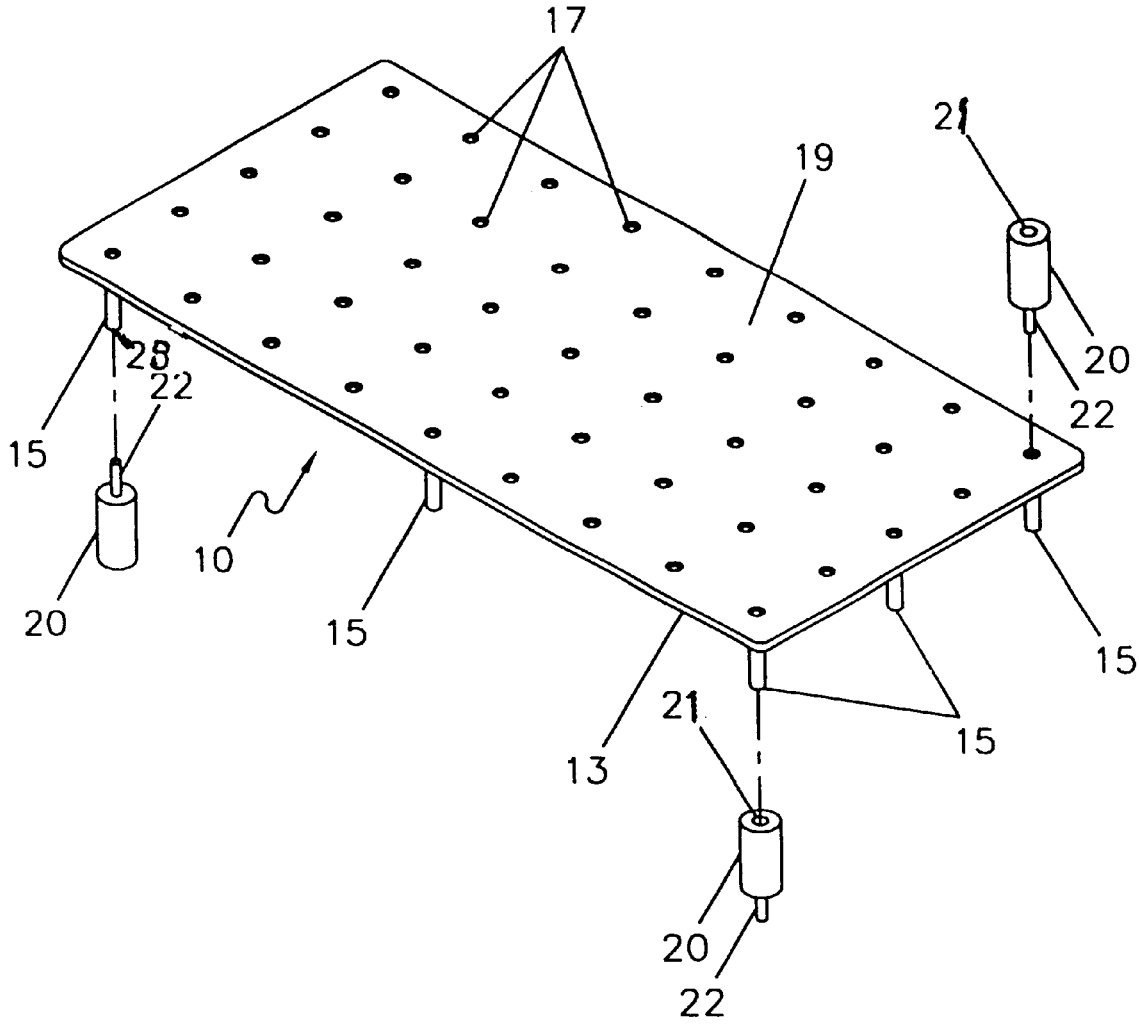
FIG. 2 is a perspective view of a stackable shelf according to the present invention, shown with leg extensions.
Figure 3:
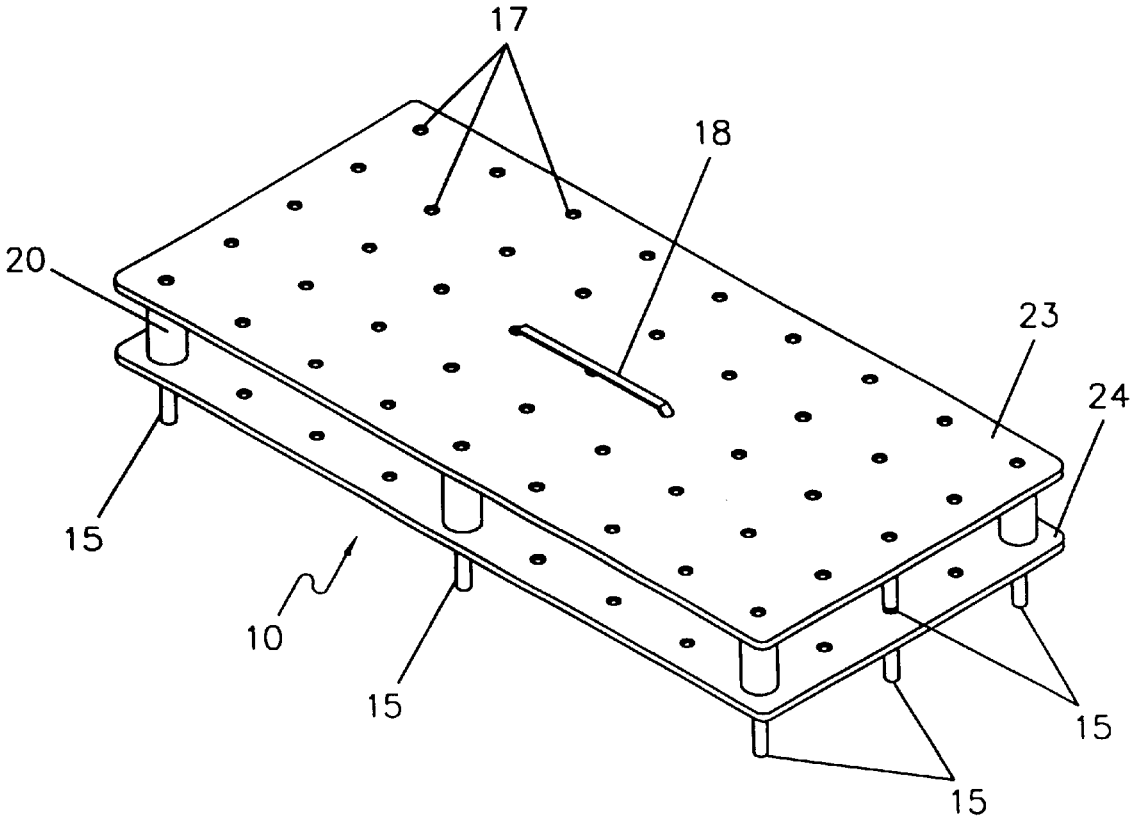
FIG. 3 is a perspective view of a cooler shelving system according to the present invention.

Referring to FIGS. 1 through 3, the shelf 12 is supported by generally cylindrical, preferably hollow, same-sized stationary legs 15 projecting downward from the bottom surface 25 of the shelf 12. The stationary legs 15 are oriented in a vertical direction on the horizontally extending shelf 12. These identical stationary legs 15 are preferably affixed to, or molded into, the one-piece shelf 12. The stationary legs 15 are preferably evenly spaced across each edge 13 of the shelf 12, as shown in FIG. 2, with one stationary leg 15 at the center of the shelf 12; however, a different number of stationary legs could also be used, with more legs (to a reasonable extent) providing proportionally greater support.

As illustrated in FIGS. 1–3, 5 and 6, the stationary legs 15 are of sufficient height so that the drain plug 29 typically found in a cooler 11 will be lower than the shelf 12, as shown in FIG. 1, thus allowing ice melt to be drained through the drain plug 29 without removing the shelf 12. The positioning of the shelf 12 above the drain plug 29, with ice kept above the shelf, also prevents ice from blocking the drain and restricting the flow of water through the drain 29. The shelf also prevents ice substitutes, and sweat from the surface of ice substitutes, from contacting items on the shelf. The shelving system of the present invention also increases the number of items that can be stored inside a cooler, by doubling or tripling the horizontal support space available. Three stationary legs 15 are seen from a side (FIG. 6) and three from one end (FIG. 5) of the shelf 12, which is shown upended in FIG. 5 for purposes of illustration.

As shown in FIGS. 1 through 4, the shelf 12 is perforated with spaced-apart, small apertures 17. The apertures 17, which are preferably evenly spaced and the same size as each other, allow water from melting ice stored above the shelf system 10, or any fluids spilled in the cooler, to drain through the shelf 12. Melted ice seeps through the apertures 17 in the shelf 12, so the food and other items on the shelf do not become soggy. The apertures 17 also allow better circulation of air through the interior of the cooler 11.

Figure 4:
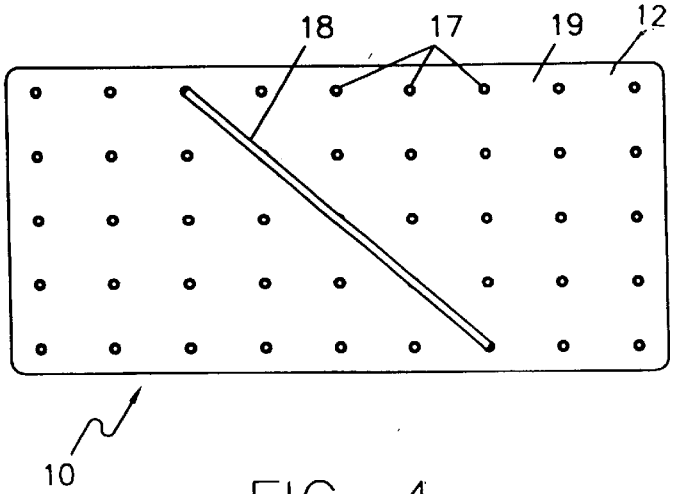
FIG. 4 is a top plan view of the shelf according to FIG. 1, shown without the cooler.
Figure 5:
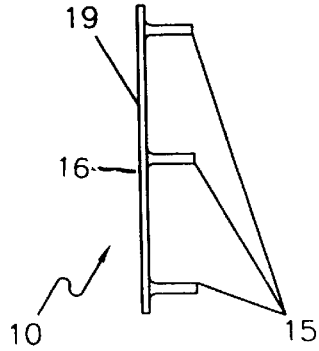
FIG. 5 is an end view of the shelf according to FIG. 4.
Figure 6:
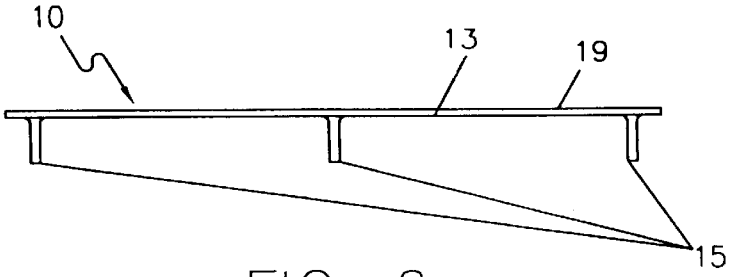
FIG. 6 is a side view of the shelf according to FIG. 4.

Referring to FIGS. 1 and 4, a preferred embodiment of the shelf system 10 also includes a generally flat, flexible handle 18 positionable across, and preferably contacting, an upper surface 19 of the shelf 12. The handle 18 has two opposite, like ends. Each handle end is closely and detachably insertable in at least one of the shelf apertures 17. Ordinarily, the approximate center of the handle 18 crosses over a centerpoint of the shelf 12, so that the weight of the shelf is substantially evenly balanced. The handle 18 is preferably attached diagonally across the shelf 12, as shown in FIGS. 1 and 4. The diagonal position of the handle 18 provides good stability so that when the shelf 12 is lifted by the handle 18, it is unlikely to tip to one side or the other. The handle 18 may also be oriented substantially parallel to either edge 13 of the shelf 12, if desired, as shown in FIG. 3. The handle is detachably attached to the apertures 17 in the shelf 12, so that it may be removed and repositioned in other apertures of the shelf, or may be removed and dispensed with altogether.

The preferred embodiment of the shelf system 10 shown in FIGS. 1 through 3 also includes reusable, reversible leg extensions 20, which are removably attachable to the stationary legs 15 and insertable in the apertures 17 of the shelf. The leg extensions are used to distance the shelves from one another and the lowermost shelf from the floor of the cooler. Each leg extension 20 is cylindrical in shape along its longitudinal axis, and has a greater diameter than the stationary legs 15. Each leg extension 20 has a central channel 21 in one of its ends. The channel 21 is of large enough dimension for a stationary leg 15 to be inserted closely into it. Thus, the diameter of the channel 21 is slightly greater than the diameter of the stationary leg 15, and the channel is preferably approximately the length of a stationary leg 15.

Continuing with FIGS. 1–3, each leg extension 20 has at its opposite end a cylindrical projection 22 of smaller diameter than the remainder of the leg extension. The projection 22 is of a dimension just small enough to allow close insertion into any of the apertures 17 from the upper surface 19 of the shelf 12, or into the bore 28, or hollow, in the bottom of a stationary leg 15. The projection 22 has a diameter only slightly less than the diameter of the apertures 17, which is approximately the same as the diameter of the hollow in the stationary leg 15. In the preferred embodiment, the projection 22 has a length approximately the same as the length of the bore 28 in the stationary leg 15. The bores 28 in the stationary legs 15 preferably extend the length of the stationary leg 15. In the preferred embodiment, the apertures 17 are identical to one another, the stationary legs 15 are identical to one another, and the leg extensions 20 are identical to one another. The projection 22 at the end of the leg extension 20, as well as the stationary legs 20, are preferably straight as shown, though they can be flared, etc.

As illustrated by FIG. 2, either end of the leg extension 20 can be used. For the purposes of illustration, FIG. 2 shows three alternatives for use of the leg extensions 20. The projection 22 of the leg extension 20 is insertable into the hollow of a stationary leg 15, as shown on the left side of FIG. 2, to extend the length of the leg, and/or the distance of the shelf 12 from the bottom of the cooler. Alternatively, the leg extension 20 can be flipped over and the channel 21 can be pushed over the outside of a stationary leg 15, as shown on the right side of FIG. 2, to form a connector to the shelf below. A third alternative is insertion of the leg extensions 20 into the apertures 17 from the top of the shelf 12 to form connectors to a shelf above, as shown at the top right of FIG. 2. It can be seen that the leg extensions 20 are versatile, and many different shelf configurations 10 can be formed with them.

As shown in FIG. 3, once they are inserted into the apertures 17 from the upper surface 19 of the shelf 12, the leg extensions 20 may be used to support the stationary legs 15 of another shelf 23, which are inserted into the channels 21 in the leg extensions 20. Thus, the shelves 12 may be stacked one on top of another until the cooler is full. Where several shelves 12 are stacked, the handle 18 is typically attached only to the uppermost shelf 23, although a second handle 18 could also be attached to a second shelf 24, and so forth. Where several handles are utilized, the handles can be attached to different positions on the various shelves, as desired by the user. Once the first handle 18 is used to remove the uppermost shelf 23, the second handle 18 is employed by the user to remove the second shelf 24, and so forth. The handles 18 may be attached parallel to the side edges of the shelves 10, as shown in FIG. 3, or diagonally, as shown in FIGS. 1 and 4, as desired. Where several handles are utilized, two handles 18 can be criss-crossed, forming an X-shape when viewed from above. The projections 22 of the leg extensions 20 may also be inserted from below into the bores 28 in the stationary legs 15 and serve as feet for supporting and stabilizing the lowermost shelf 24. The leg extensions 20 stay in place on the shelf legs because of the close fit of the projection in the bore, the weight of the shelf and the goods on it, and moisture in the cooler forming a seal in the bore.

Continuing with FIG. 3,.a preferred shelving system 10 according to the present invention comprises at least two same-sized shelves 12, and a plurality of same-sized leg extensions 20. This preferred shelving system 10 further includes a removable, generally flat, flexible handle 18 attachable at its opposite ends to apertures 17 in the upper surface 19 of an uppermost shelf 23 in the shelving system. A number of shelves 10 can be stacked on one another. Items of different dimensions and type can be placed on the different shelves 10 in the shelving system, as desired. Items which are more sensitive to cold/ice or water/ice melt, for example, can be placed on the center shelf or shelves in a shelving system of the present invention. Several shelves 12 can alternatively be stacked on one another by inserting the stationary legs 15 of one shelf 12 into apertures 17 in the shelf below. With the leg extensions 20, the shelves 10 are quite versatile and the shelving systems 12 can be custom-built by the user.

Sometimes, the interior edges of a conventional cooler are curved, so a shelf with legs along its outside edges would not be usable in such a cooler. The present invention allows the legs 20 to be placed wherever user desires. The reversible extension leg 20 with the projection 22 inserted in apertures 17 that are not at the periphery of the shelf 12 lifts the shelf 12 off the bottom of the cooler 11. For example, four two-inch reversible leg extensions in the inside (i.e., not peripheral) apertures 17 (see FIG. 4) would lift the shelf 12 about two inches off the bottom of the cooler. The shelf 12 may or may not have stationary legs 15. If there were stationary legs 15, they would be suspended off the bottom surface of the cooler by the leg extensions 20.

The shelf 12 will preferably be made of a suitable material, such as plastic, that is sufficiently rigid, waterproof, lightweight, and easily cleaned. The leg extensions 20 will preferably be made of a material, such as rubber or plastic, that will not scratch the interior lining of the cooler 11. The shelf 10 and shelving system 12 are easily and inexpensively manufactured.

Advantages of the present invention include separation of perishable items such as fish, shrimp, bait, etc. from ice melt water, ice, and ice substitutes. By storing ice above the shelf 12, melt water is allowed to drip down and through the shelf, thus reducing the risk of contamination of the water and the items on the shelf. One can also store ice below the shelf, thereby keeping goods separated from ice, and ice melt, when desired. Also, by using two or more shelves, one can store live crabs, for example, apart from the ice or ice melt water, keeping the crabs alive and fresh longer. A shelf according to the present invention can be made in several sizes, corresponding to the conventional sizes of widely available coolers, thus allowing flexibility of use. Alternatively, a shelf which fits in a smaller conventional cooler size can be used in a larger cooler, or the shelf may include a shelf extension for extending the shelf to the length of the larger conventional cooler size. Also, the shelf is positioned so that the drainage of water from the cooler by means of the cooler's drain plug is maintained and improved. The shelf can also be used for separating different types of goods stored in a cooler from one another.

Figure 7:
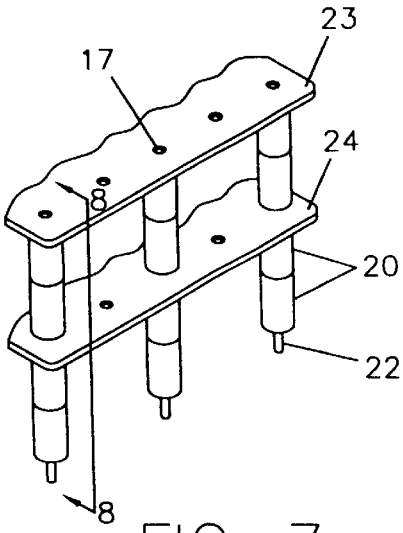
FIG. 7 is a side perspective view of an end of an alternate embodiment of a cooler shelving system according to the present invention.
Figure 8:
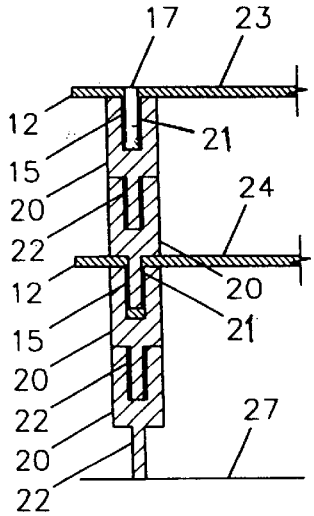
FIG. 8 is a cross-sectional view of a portion of a cooler shelving system according to FIG. 7.

Referring to FIGS. 7 and 8, a shelving system 10 includes two shelves 12, with two layers of leg extensions 20 between each shelf 23, 24, and between the bottommost shelf 24 and the floor 27 of the cooler 11. FIG. 8 shows a cross-section through a tier of shelves 23, 24 and leg extensions 20. Here, the stationary leg 15 of the uppermost shelf 23 was inserted into the channel 21 of the uppermost, first leg extension 20. The projection 22 of the first leg extension 20 was inserted into the channel 21 of the second leg extension 20. This is repeated the desired number of times. It is not necessary to cover every stationary leg 15 with a leg extension 20.

Continuing with this embodiment, the projection 22 of the second leg extension 20 was inserted into an aperture 17 of the lowermost shelf 24. As shown in FIGS. 7 and 8, the two shelves 23, 24 are parallel and correspond in position to one another. The stationary leg 15 of the lowermost shelf 24 was inserted into the channel 21 of the third leg extension 20. The projection 22 of the third leg extension 20 was inserted into the channel 21 of the lowermost, fourth leg extension 20. This is repeated the desired number of times. When the shelving system is inserted in the cooler, the projections 22 of the fourth leg extensions contact the floor 27 of the cooler. The stationary legs 15 and leg extensions 20 can be positioned over/under other apertures 17 without defeating the functionality of the invention.

Figure 9:
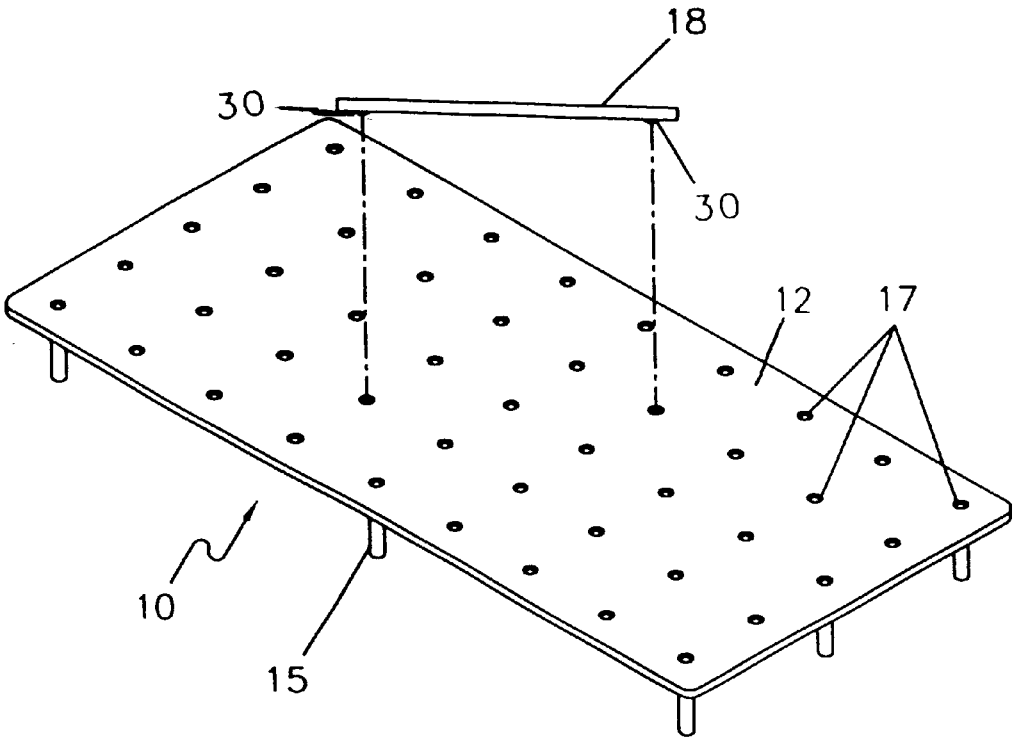
FIG. 9 is a top perspective view of a cooler shelf according to the present invention, showing a detachable handle.
Figure 10:
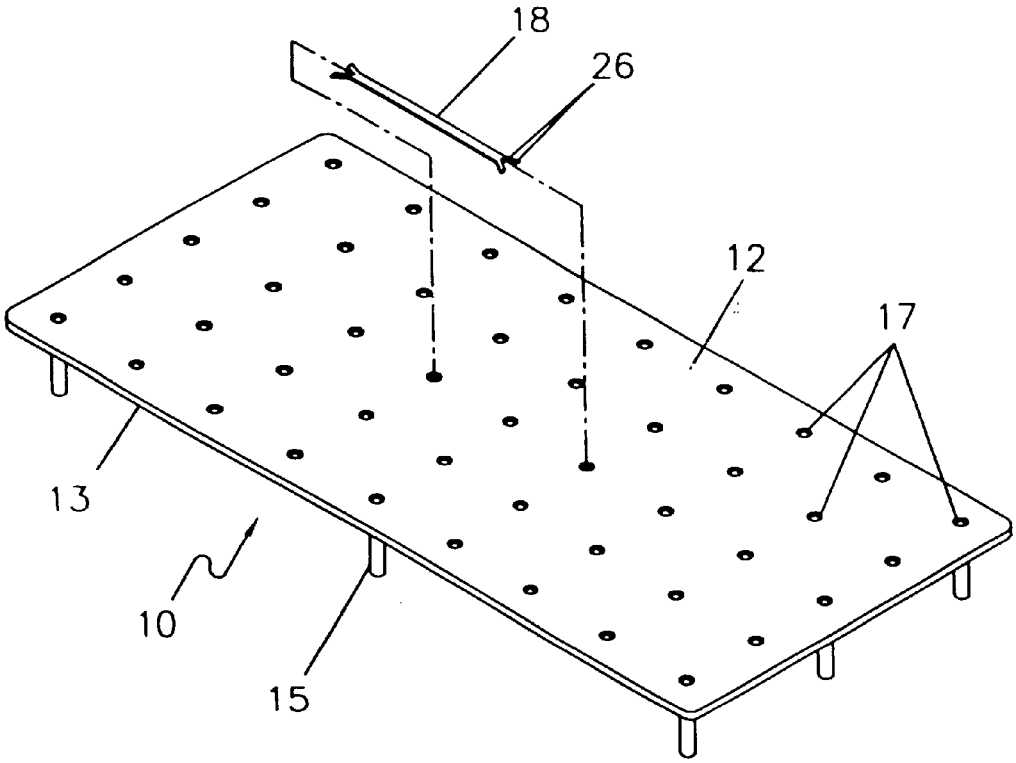
FIG. 10 is a top perspective view of a cooler shelf according to the present invention, showing an alternate detachable handle.

Two alternate embodiments of handles 18 are illustrated in FIGS. 9 and 10. The flat handle 18 is preferably made of a suitable plastic. Each end of the handle 18 is affixable in a shelf aperture 17, the distance between the subject apertures being substantially the same as the length of the handle. Since the handle 18 is flexible, it could be placed in apertures 17 which are closer together, in which case the handle would bow upward, rather than remaining relatively flat against the shelf. One advantage of a relatively flat, plastic handle is that items can be placed on it without impairing its usefulness (once it is again uncovered).

In FIG. 9, each end of the flexible handle 18 includes a same-sized nipple 30 on its lower surface. The nipple 30 is sized to closely fit into an aperture 17, so that the handle 18 stays in place when the shelf 12 is lifted out of the cooler 11 by the user, yet is detachable. The handle 18 is removable by pulling the nipples 30 out of the apertures 17. When viewed from the bottom of the shelf 12, only the nipples 30 can be seen emerging from the apertures 17. Thus, the nipples 30 are closely insertable in two corresponding ones of the apertures 17, and the handle 18 is removable.

In FIG. 10, each end of the handle 18 is pronged and flexible, so that the same-sized prongs 26 on the end of a handle fit closely through an aperture 17. The handle 18 is removable by pulling the prongs 26 out of the apertures 17. The handle ends can then be repositioned in any desired apertures 17 in the shelf 12. Thus, the flexible prongs 26 of a handle end are closely insertable in at least one of the apertures 17, and the handle is removable.

Figure 11:
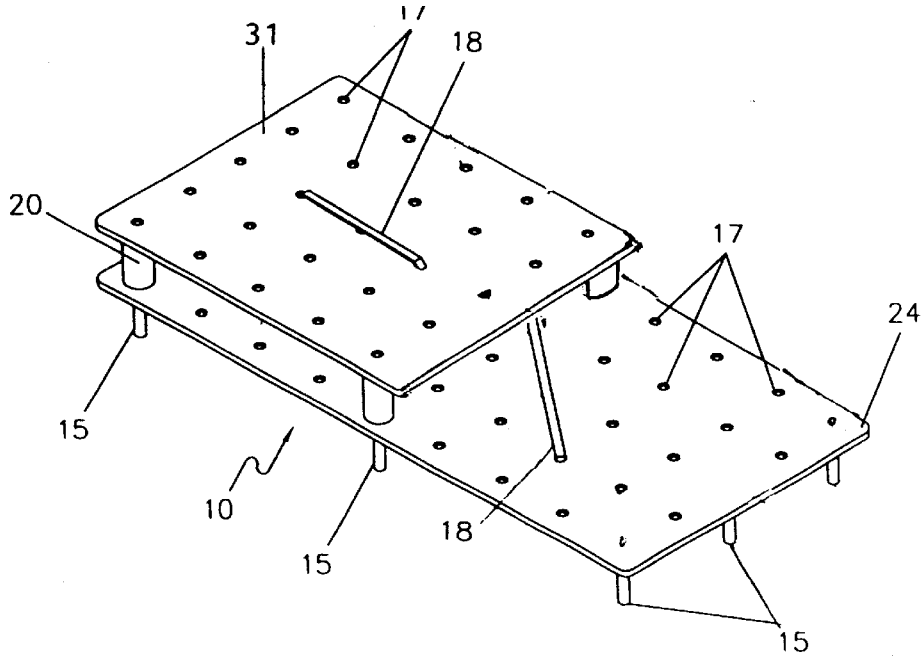
FIG. 11 is a perspective view of an alternate embodiment of a cooler shelving system according to the present invention, including a half-shelf.

An alternate embodiment of a shelving system 10 is shown in FIG. 11. With the leg extensions 20 of the present invention, a short (half) section of a shelf 31 can be stacked on a longer, cooler-length shelf 24. This shelving system 10 will accommodate both tall and short items in the cooler. The tall items, such as wine bottles, are placed on the lower shelf 24, while shorter items, such as small, plastic food storage containers, are placed under or on the half-shelf 31. Using leg extensions 20, the half-shelf 31 can be built up above the level of the lower, full shelf 24 as much as is desired, according to the height of the items to be placed on the lower shelf 24.

The shelving system 10 of FIG. 11 includes two handles 18. The handle 18 on the upper, half-shelf 31 is parallel to the side edges of the shelf, and the lower handle 18 on the lower shelf 24 is diagonal. One layer of leg extensions 20 separates the upper shelf 31 from the lower shelf 24, though two or more layers of leg extensions 20 can be employed. Stationary legs 15 are shown projecting down from the lower shelf 24, although one or two layers of leg extensions 20 can be employed.

Thus, there are many options for the shelving system 10, including:

(a) the projection 22 of the leg extension 20 is insertable from the top of the shelf 12 into an aperture 17 in the shelf, the aperture leading to an upper end of the stationary leg beneath the shelf, wherein each leg extension 20 projects in the same generally vertical direction as the leg 15.

(b) there are at least two of the shelves, an upper one 23 of the shelves being above and parallel to a lower one 24 of the shelves, the upper shelf 23 having a length which is about half the length of the lower shelf 24, the width of both shelves being about equal to one another.

(c) the projections 22 of a set of leg extensions are inserted into the bores 28 of a corresponding number of the stationary legs 15 of the shelf.

(d) there are at least two of the shelves, a plurality of the leg extensions 20, and at least one of the handles; an upper one 23 of the shelves being above and parallel to a lower one 24 of the shelves; the lower shelf 23 comprising a plurality of the stationary legs 15; the upper shelf 23 not comprising any stationary legs.

(e) two of the shelves each comprise at least four stationary legs 15, an upper one 23 of the shelves being above, parallel to, and substantially the same size as a lower one 24 of the shelves; at least four of the stationary legs 15 of an upper one of the shelves being inserted in one each of the channels 21 of a first set of the leg extensions 20.

(f) the projections 22 of the first leg extensions being inserted into corresponding apertures 17 of the lower shelf 24.

(g) the projections 22 of the first leg extensions are inserted into channels 21 in a second set of leg extensions, the projections 22 of the second set of leg extensions being inserted into corresponding apertures 17 in the lower shelf 24.

(h) at least four of the stationary legs 15 of the lower shelf 24 are inserted into one each of the channels 21 of a second set of the leg extensions.

(i) the projections 22 of a third set of leg extensions are inserted into the bores 28 of a corresponding number of the stationary legs 15 of the lower shelf 24.

Figure 12:
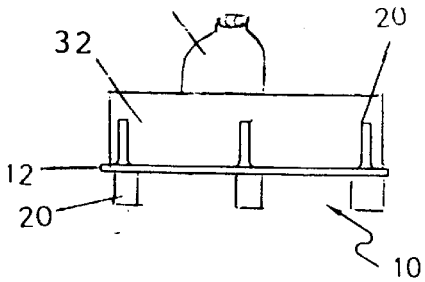
FIG. 12 is an elevational end view of an alternate embodiment of a cooler shelf according to the present invention, including a leg extension divider.

Referring to FIG. 12, the shelving system 10 may include one or more dividers 32, which are leg extensions 20 with flat dividers or partitions 32 extending from them. The divider 32 may be continuous with or affixed to one or more leg extensions 20, or it may detach from one or more leg extensions 20, as by snapping or clasping onto the projection 22. Dividers 32 are preferably flat and rectangular in shape, as shown in FIG. 12, in which three leg extensions 20 support one divider 32. In FIG. 12, the divider 32 is shown separating a bottle 33 from items (not shown) on the opposite side of the divider 32. In FIG. 12, a number (three shown) of leg extensions 20 extend below the shelf 12.

Dividers 32 are useful for separating groups of items placed on the shelves 12, and organizing the contents of the cooler. Dividers 32 can be used, for example, to segregate frozen items from cool items. In this example, little to no ice or ice substitutes would be placed on the cool side of the cooler, though ice and/or ice substitutes would be placed above or below the frozen goods on the adjacent side of the cooler.

Figure 13:
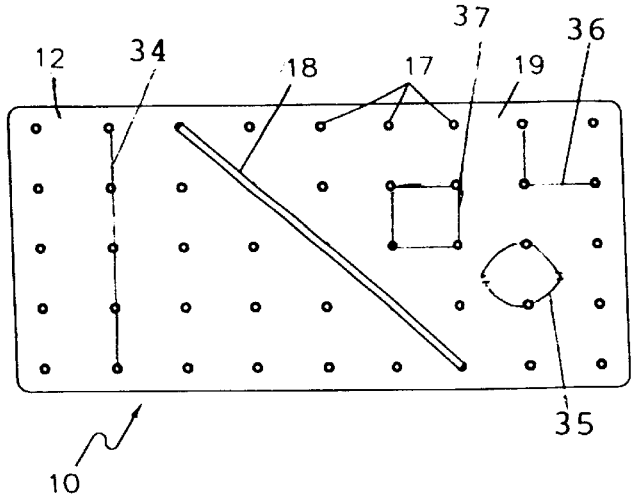
FIG. 13 is a top plan view of an alternate embodiment of an upper cooler shelf according to the present invention, showing various dividers and a handle.

A cooler shelving system 10 can be customized for a particular use by arranging the leg extensions 20 and dividers 32 in a desired manner. FIG. 13 shows a top plan view of one such configuration: a shelf 12 with apertures 17 into which a number of such dividers 32 has been inserted. Dividers 32 may be planar and straight for partitioning the area above the shelf, or curved, so that they may be used for supporting bottles or cans, for example. The dividers 32 may extend the width or length of the shelf, or they can extend only an inch or two next to the aperture 17 into which the leg projection 22 has been inserted. The dividers 32 may have a height up to the top of the cooler 11, if desired, but are preferably several inches in length and height. In the embodiment shown in FIG. 13, two or four of the dividers 32 form a linear partition 34 across an end of the shelf 12, two like-sized, curved dividers form a circular partition 35 for holding a can of beverage, an L-shaped partition 36 at one comer can support a box, for example, and two L-shaped partitions 36 placed end to end form a square-shaped partition 37.

Thus, one or more of the dividers 32 may make up a linear partition 34 across the shelf; a square-shaped partition 37, with each comer of the square corresponding to an adjacent aperture of the shelf; a generally circular partition 35 comprised of two same-sized, curved dividers; and/or a generally L-shaped partition 36 formed of a single divider with an apex at the comer of the L shape, or two dividers at a right angle to one another.

An alternative shelving system 10, includes:

(a) at least one generally flat, rectangular-shaped, unitary shelf 12;

(b) a plurality of spaced-apart, same-sized apertures 17 in the shelf 12;

(c) a plurality of evenly spaced, same-sized, stationary legs 15 projecting down in a generally vertical direction from the generally horizontally oriented shelf 12; and (d) at least one generally flat, flexible handle 18 positioned across an upper surface of the shelf, the handle 18 having two opposite ends, each handle end being removably and closely insertable into one of the shelf apertures 17. The shelving system preferably further comprises a plurality of same-sized, reversible leg extensions 20, each comprising a channel 21 in one end, the channel 21 having a diameter of a size for closely accommodating one of the stationary legs 15, at least a bottom portion of one of the stationary legs 15 being insertable into the channel 21 in the leg extension 20; each leg extension 20 further comprising a projection 22 on an opposite end of the leg extension; the projection 22 being closely insertable in at least one of the apertures 17. At least one of the leg extensions 20 preferably further includes a divider 32 attached to the portion of the leg extension 20 having the channel 21, each divider leg extension being removably insertable in at least one of the apertures 17 of the shelf 12.

The present invention also includes a kit for building a shelving system for use in a cooler. The kit comprises:

(a) at least two generally flat (planar), rectangular-shaped, one-piece, stackable shelves 12, each shelf 12 comprising: a plurality of evenly spaced, same-sized stationary legs 15 projecting downward in a generally vertical direction from the horizontally oriented shelf 12, each stationary leg 15 comprising a central bore 28; and a plurality of spaced-apart apertures 17 in the shelf;

(b) at least one generally flat, flexible, removable handle 18, each handle 18 extending across a portion of an upper surface 19 of one of the shelves 12, each handle 18 having two opposite ends, each handle end being detachably insertable in a shelf aperture 17, the approximate center of the handle 18 crossing a centerpoint of the shelf 12; and (c) a plurality of reversible leg extensions 20, each leg extension 20 having two ends, one leg extension end comprising a channel 21, the opposite leg extension end comprising a projection 22, the projection 22 being insertable into the bore 28 of one of the stationary legs 15; the stationary leg 15 being insertable into the channel 21 of the leg extension 20.

From the foregoing it can be realized that the described device of the present invention may be easily and conveniently utilized as a shelf for a cooler or ice chest for separating the goods stored in the cooler from the ice or from ice melt. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 shelving system
11 cooler
12 shelf
13 side edges of shelf
14 interior sides of cooler
15 stationary leg
16 end of shelf
17 aperture in shelf
18 handle
19 upper surface of shelf
20 leg extension
21 channel in leg extension
22 projection on leg extension
23 uppermost shelf
24 lowermost shelf
25 lower surface of shelf
26 handle prongs
27 floor of cooler
28 bore in stationary leg
29 cooler drain plug
30 nipple on handle
31 half-shelf
32 divider
33 bottle
34 linear partition
35 circular partition
36 L-shaped partition
37 square-shaped partition

What is claimed is:

1. An adjustable, removable shelving system for separating items stored in a cooler from ice or water in the cooler, the shelving system comprising:

(a) at least one generally flat, rectangular-shaped, unitary shelf;

(b) a plurality of spaced-apart, same-sized apertures in the shelf;

(c) a plurality of evenly spaced, same-sized, stationary legs projecting down in a generally vertical direction from the generally horizontally oriented shelf; and (d) at least one generally flat, flexible handle positioned across an upper surface of the shelf, the handle having two opposite ends, each handle end being removably and closely insertable into one of the shelf apertures.

2. A shelving system according to claim 1, further comprising a plurality of same-sized, reversible leg extensions, each comprising a channel in one end, the channel having a diameter of a size for closely accommodating one of the stationary legs, at least a bottom portion of one of the stationary legs being insertable into the channel in the leg extension; each leg extension further comprising a projection on an opposite end of the leg extension; the projection being closely insertable in at least one of the apertures.

3. A shelving system according to claim 2, wherein at least one of the leg extensions further comprises a divider attached to the portion of the leg extension having the channel, each divider leg extension being removably insertable in at least one of the apertures of the shelf.

* * * * *